US008528609B2

(12) United States Patent
Garrison et al.

(10) Patent No.: US 8,528,609 B2
(45) Date of Patent: Sep. 10, 2013

(54) REFILLING NOZZLE WITH VAPOR RECOVERY RELIEF VALVE

(75) Inventors: Timothy M. Garrison, Cincinnati, OH (US); Matthew R. Lauber, Cincinnati, OH (US); Harold M. Schubert, Fairfield, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 151 days.

(21) Appl. No.: 13/046,286

(22) Filed: Mar. 11, 2011

(65) Prior Publication Data

US 2012/0227862 A1 Sep. 13, 2012

(51) Int. Cl.
*B67D 7/36* (2010.01)
*B67D 7/48* (2010.01)

(52) U.S. Cl.
CPC ..... *B67D 7/48* (2013.01)
USPC ..... 141/206; 141/59; 137/205

(58) Field of Classification Search
USPC ..... 141/59, 206, 4, 5, 7, 39, 40, 43, 197; 137/205
See application file for complete search history.

(56) References Cited

U.S. PATENT DOCUMENTS

| | | | | |
|---|---|---|---|---|
| 2,582,195 | A | 1/1952 | Duerr | |
| 4,056,131 | A * | 11/1977 | Healy | 141/206 |
| 4,453,578 | A | 6/1984 | Wilder | |
| 5,121,777 | A | 6/1992 | Leininger et al. | |
| 5,390,712 | A * | 2/1995 | Parrish et al. | 141/59 |
| 5,421,382 | A | 6/1995 | Leininger et al. | |
| 5,474,115 | A * | 12/1995 | Fink, Jr. | 141/206 |
| 5,676,181 | A | 10/1997 | Healy | |
| 7,509,982 | B2 * | 3/2009 | Grantham | 141/59 |
| 8,167,003 | B1 * | 5/2012 | Clever et al. | 141/59 |
| 2005/0121100 | A1 | 6/2005 | Riffle | |
| 2007/0267089 | A1 | 11/2007 | Gray et al. | |

* cited by examiner

*Primary Examiner* — Timothy L Maust
*Assistant Examiner* — Robert Bell, III
(74) *Attorney, Agent, or Firm* — Thompson Hine L.L.P.

(57) ABSTRACT

A nozzle system including a nozzle body configured to dispense fuel through a fuel path thereof into a vehicle tank. The nozzle body includes a vapor path configured such that vapor recovered from the vehicle tank during refueling is passable therethrough. The nozzle system further includes a main vapor valve positioned in the vapor path and configured to selectively block the vapor path. The main vapor valve is movable to a position wherein the main vapor valve does not block the vapor path. The nozzle system further includes a relief valve in fluid communication with the vapor path. The relief valve is configured to open to allow ambient air to enter into the vapor path when sufficiently low pressure is present in the vapor path, and the relief valve is generally aligned with the main vapor valve.

25 Claims, 6 Drawing Sheets

REFILLING NOZZLE WITH VAPOR RECOVERY RELIEF VALVE

The present invention is directed to a refilling nozzle, and more particularly, to a refilling nozzle which has a relief valve to accommodate vehicles having onboard refueling vapor recovery systems.

BACKGROUND

At a typical refueling station, fuel is pumped from an underground storage tank through a fuel dispenser, a hose and associated nozzle to the vehicle fuel tank. As the fuel enters the vehicle fuel tank, hydrocarbon vapors from inside the tank are exhausted or forced out of the tank. Environmental laws and/or regulations may require that vapors emitted from the vehicle fuel tank during refueling be captured and returned to the underground fuel storage tank. The captured vapor is returned through the vapor path of the nozzle, hose, dispenser and underground piping system back to the ullage space of the underground fuel storage tank. Balanced refilling systems are configured such that vapor forced out a vehicle tank is moved toward the storage tank by the pressure of fluid flowing into the vehicle tank.

An increasing number of vehicles include an onboard refueling vapor recovery ("ORVR") system configured to capture/reclaim the vapor that would otherwise be emitted from the fuel tank during refueling. The ORVR system routes or feeds the vapor to a capture canister which includes activated carbon. When the refueling process is complete and the vehicle engine is running, vapor in the capture canister is fed to the engine where the vapors are burned during the combustion process.

A liquid seal ORVR system (the most common ORVR system) is typically designed such that the vehicle fill pipe leading to the vehicle fuel tank has a progressively reduced inner diameter. This configuration ensures that fuel flowing into the fill pipe covers or extends continuously across the cross section of the fill pipe during refueling to form a liquid seal, which prevents fuel vapor from escaping through the fill pipe. The reduction in diameter of the fill pipe also causes a vacuum to be generated during refueling due to the venturi effect. The phenomenon, known as an injector effect, draws surrounding air/vapor into the fuel flow stream, and creates a positive pressure in the vehicle fuel tank that forces the vapors into the vapor capture canister carried on the vehicle. However, a vehicle equipped with an ORVR system (i.e. an ORVR vehicle) can create a negative pressure in the nozzle, which can interfere with the proper operation of the nozzle/refueling system.

SUMMARY

Accordingly, in one embodiment the invention is a nozzle system which includes a relief valve such that a negative pressure in the system can be alleviated. In particular, in one embodiment the invention is a nozzle system including a nozzle body configured to dispense fuel through a fuel path thereof into a vehicle tank. The nozzle body includes a vapor path configured such that vapor recovered from the vehicle tank during refueling is passable therethrough. The nozzle system further includes a main vapor valve positioned in the vapor path and configured to selectively block the vapor path. The main vapor valve is movable to a position wherein the main vapor valve does not block the vapor path. The nozzle system further includes a relief valve in fluid communication with the vapor path. The relief valve is configured to open to allow ambient air to enter into the vapor path when sufficiently low pressure is present in the vapor path, and the relief valve is generally aligned with the main vapor valve.

DETAILED DESCRIPTION

Figures 1, 1A:
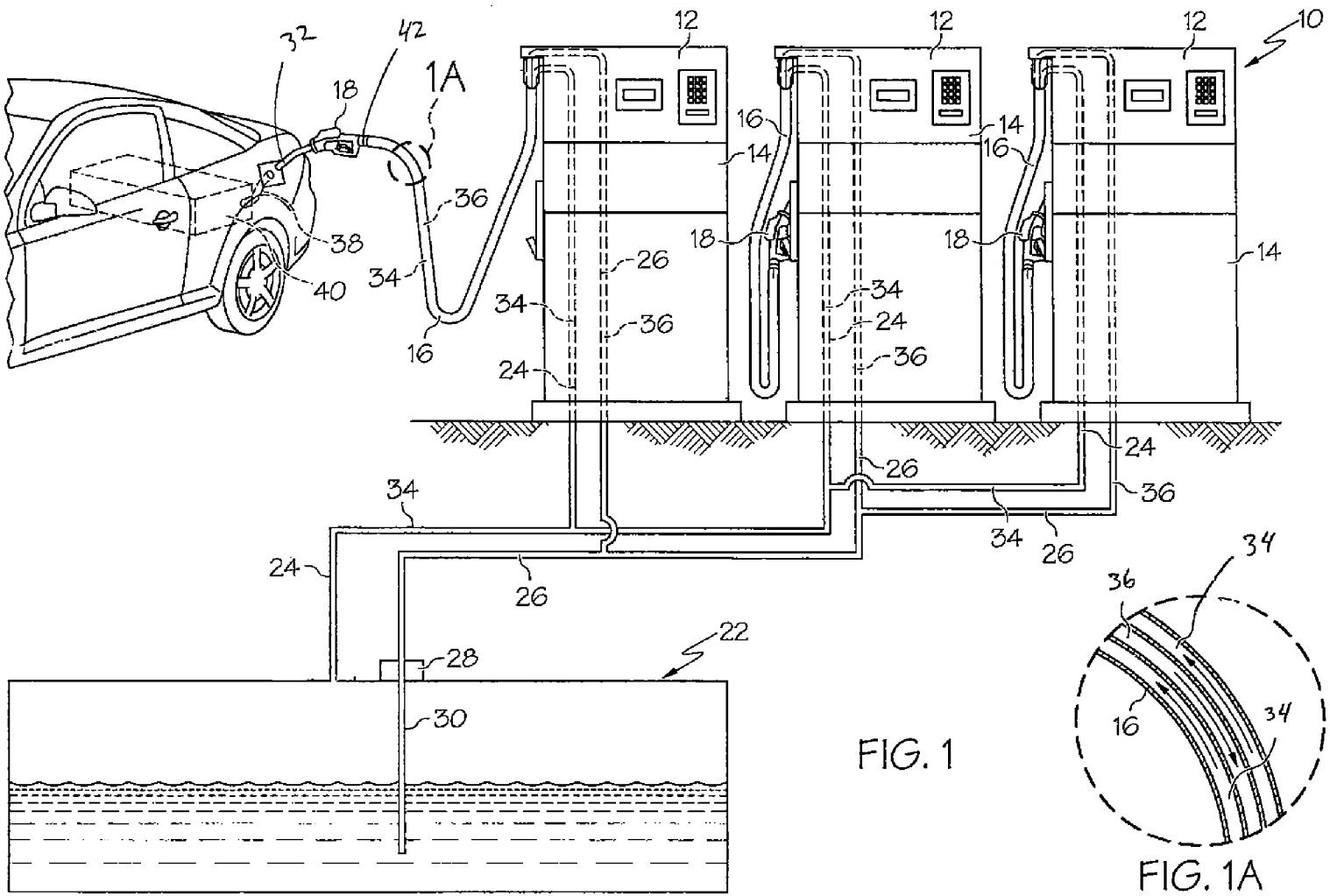
FIG. 1 is a schematic representation of a refueling system shown in conjunction with a vehicle to be refueled.
FIG. 1A is a detail view of the area designated in FIG. 1.

FIG. 1 is a schematic representation of a refilling system 10 including a plurality of dispensers 12. Each dispenser 12 includes a dispenser body 14, a hose 16 coupled to the dispenser body 14, and a nozzle 18 positioned at the distal end of the hose 16. Each hose 16 may be generally flexible and pliable to allow the hose 16 and nozzle 18 to be positioned in a convenient refilling position as desired by the user/operator.

Each dispenser 12 is in fluid communication with a fuel/fluid storage tank 22 via a fluid conduit 26 that extends from each dispenser 12 to the storage tank 22. The storage tank 22 includes or is fluidly coupled to a fuel pump 28 which is configured to draw fluid out of the storage tank 22 via a pipe 30. During refilling, as shown by the in-use dispenser 12' of FIG. 1, the nozzle 18 is inserted into a fill pipe 38 of a vehicle fuel tank 40. The fuel pump 28 is then activated to pump fuel from the storage tank 22 to the fluid conduit 26, hose 16 and nozzle 18 and into the vehicle fuel tank 40 via a fuel path 36 of the system 10.

The system 10 may also include a vapor path 34 extending from the nozzle 18, through the hose 16 and a vapor conduit 24 to the ullage space of the tank 22. For example, as shown in FIG. 1A, in one embodiment the vapor path 34 of the hose 16 is received around, and generally coaxial with, an inner fluid path 36 of the hose 16. The nozzle 18 may include a flexible vapor boot or bellows 31 (FIGS. 2-6) of the type well known in the art which is coupled to, and circumferentially surrounds, a spout 32 of the nozzle 18. The bellows 31 is designed to be compressed and form a seal about the spout 32 when the spout 32 is inserted into the fill pipe 38. The bellows 31 help to capture vapors and route the vapors into the vapor path 34.

In the illustrated embodiment the system 10 lacks any vapor or suction pump fluidly coupled to the vapor path 34, and the recovered vapors are instead urged through the vapor path 34 and to the tank 22 by the increased pressure caused by fluid entering the vehicle fuel tank 40 in a so-called "balanced" system. Although FIG. 1 illustrates one particular configuration of a system 10 in which the nozzle 18 may be utilized, it should be understood that the system 10 can be varied from the particular arrangement shown in FIG. 1. In one example, a fuel pump 28 can instead be positioned at each associated dispenser 12 in a so-called "suction" system, instead of the so-called "pressure system" shown in FIG. 1. Moreover, it should be understood that the system 10/nozzle 18 disclosed herein can be utilized to store/dispense any of a wide variety of fluids, liquids or fuels, including but not limited to petroleum-based fuels, such as gasoline, diesel, natural gas, biofuels, blended fuels, propane, oil or the like, or ethanol the like.

Figure 3:
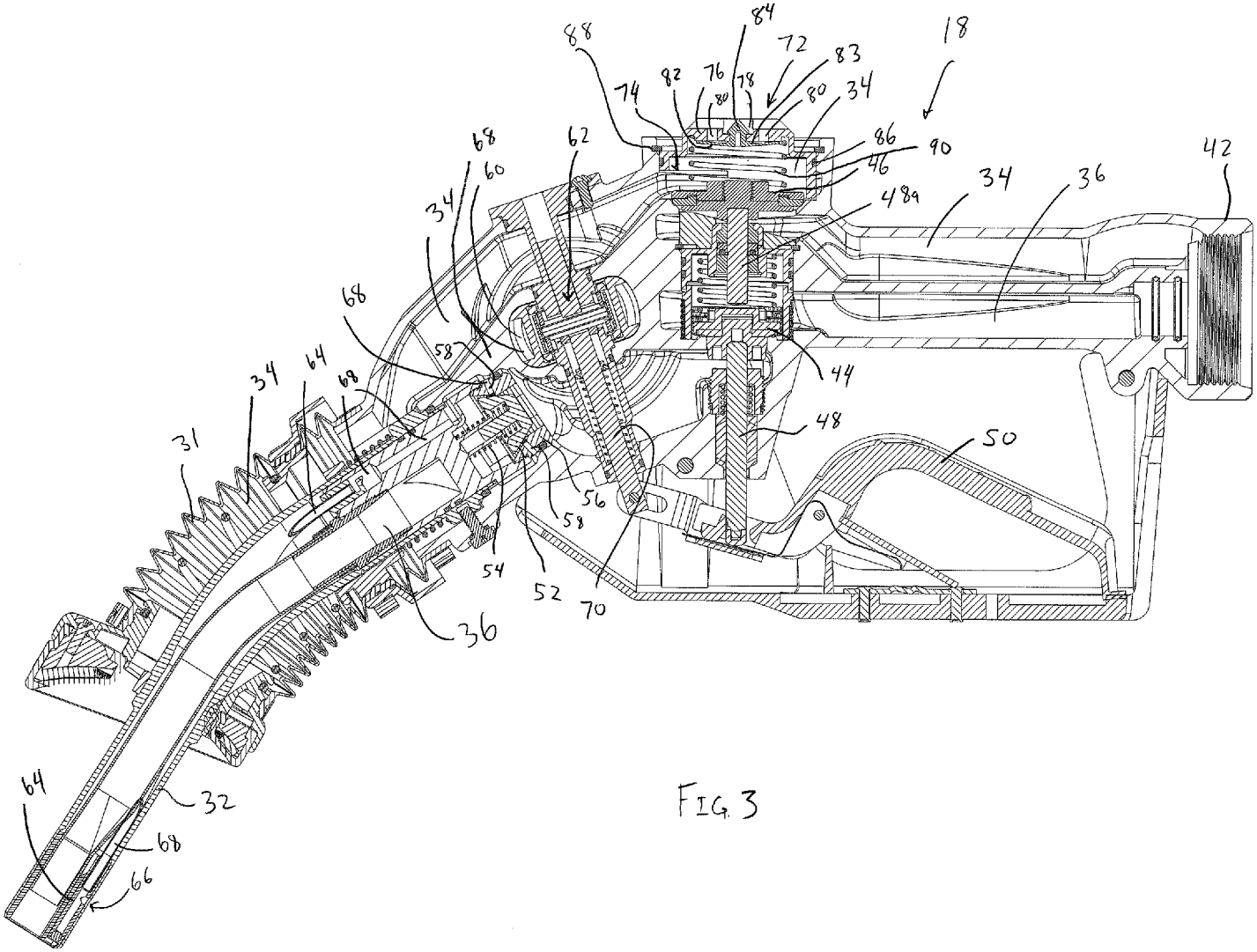
FIG. 3 is a side cross section of the nozzle of FIG. 2.
Figure 4:
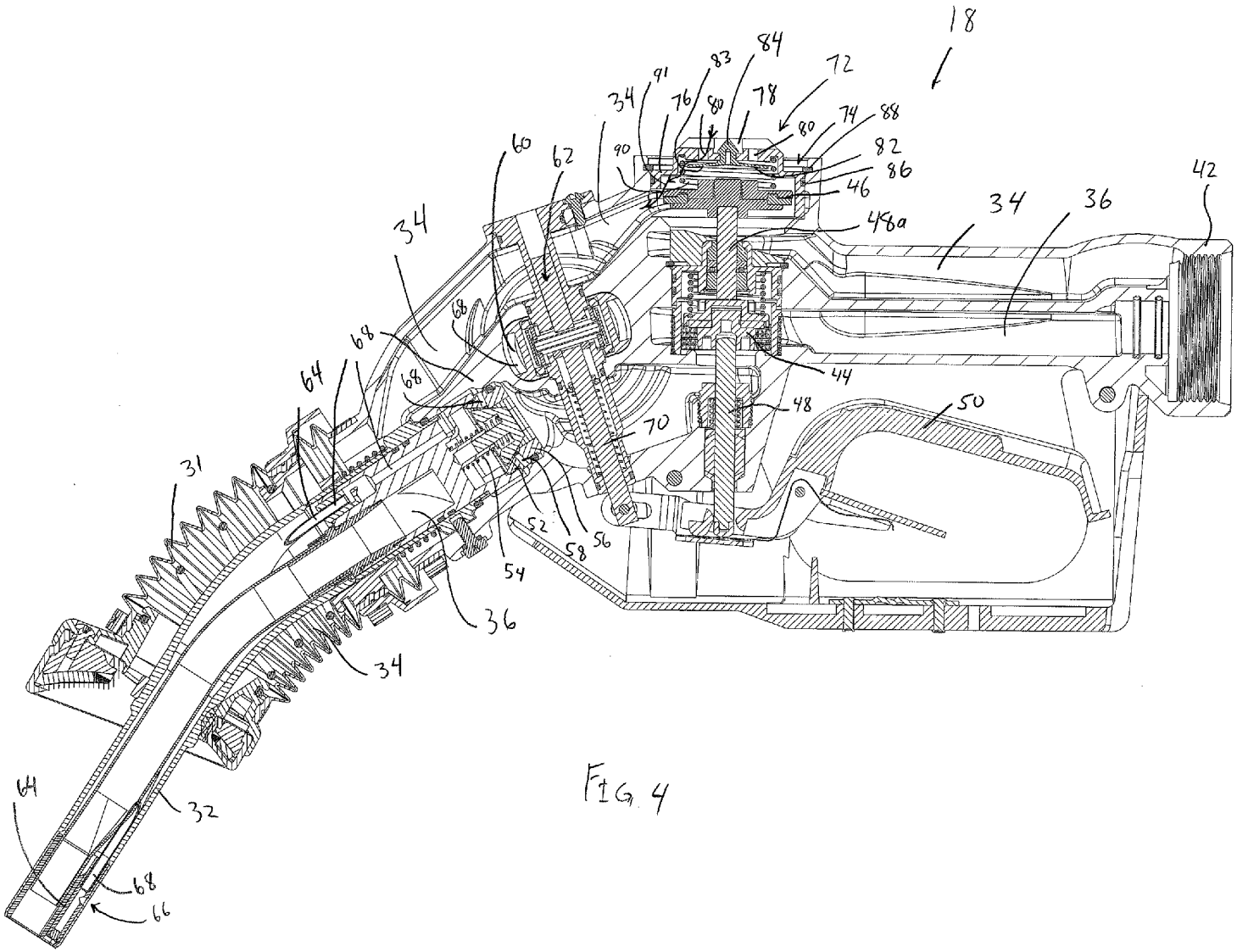
FIG. 4 is a side cross section of the nozzle of FIG. 3, with the lever raised, the main valves in their open positions, and the relief valve opened.

As best shown in FIGS. 3 and 4, the nozzle 18 includes portions of the vapor path 34 and fluid path 36 of the system 10 therein, and is fluidly coupled to the hose 16 at a threaded outlet 42. The nozzle 18 includes a main fluid valve 44 positioned in the fluid path 36 to control the flow of liquid therethrough and through the nozzle 18. Similarly, the nozzle 18 includes a main vapor valve 46 positioned in the vapor path 34 to control the flow of vapor therethrough and through the nozzle 18.

Both the main fluid valve 44 and main vapor valve 46 are carried on, or operatively coupled to, a main valve stem 48. The bottom of the main valve stem 48 is positioned above the lever 50 which can be manually raised or actuated by the user. When the user raises the lever 50 and refilling conditions are appropriate, the lever 50 engages and raises the valve stem 48, thereby opening the main vapor valve 46 and main fluid valve 44. In particular, when raised, the main vapor value 46 engages and raises the upper valve stem portion 48*a*, which carries the main vapor valve 46 thereon, opening the main vapor valve 46. As shown in FIG. 4, the valve stems 48, 48*a*, main fluid valve 44 and main vapor valve 46 are axially movable along the axis of the stems 48, 48*a*. In some cases the valves 44, 46 may be arranged such that the main vapor valve 46 starts to open before the main fluid valve 44 when the lever 50 is raised, which can improve vapor capture.

A venturi poppet valve 52 is mounted in the nozzle 18 and positioned in the fluid path 36. A venturi poppet spring 54 engages the venturi poppet 52 and urges the venturi poppet 52 to a closed position wherein the venturi poppet 52 engages an annular seating ring 56. When fluid of a sufficient pressure is present in the fluid path 36 (i.e., during dispensing operations), the force of the venturi poppet spring 54 is overcome by the dispensed fluid and the venturi poppet 52 is moved to its open position, away from the seating ring 56.

When the venturi poppet 52 is open and liquid flows between the venturi poppet 52 and the seating ring 56, a venturi effect is created in radially-extending passages 58 extending through the seating ring 56 and communicating with a chamber 60 of a shut-off device 62. The venturi passages 58/chamber 60 are also in fluid communication with a tube 64 positioned within the spout 32 (the tube 64 is continuous, but not entirely shown in the cross sections of FIGS. 3-5 due to its varying radial positioning along a length of the tube 64). The tube 64 terminates at, and is in fluid communication with, an opening 66 positioned on the underside of the spout 32 or near the distal end thereof. The tube 64, along with the venturi passages 58 and other portions exposed to the venturi pressure, form or define a sensing path 68 which is fluidly isolated from the fluid path 36 and vapor path 34 within the nozzle 18.

When the venturi poppet valve 52 is open and fluid flows through the fluid path 36, the venturi or negative pressure in the chamber 60 and sensing path 68 draws air through the opening 66 and tube 64, thereby dissipating the negative pressure. When the opening 66 is blocked, such as when fluid levels in the tank 40 during refilling reach a sufficiently high level, the source of pressure dissipation is blocked, which causes a sudden decrease in pressure in the chamber 60. The decrease in pressure in the chamber 60 of the shut-off device 62 causes an associated diaphragm of the shut-off device 62 to be moved, thereby enabling an associated plunger 70 to move downwardly. The plunger 70 then moves downwardly, causing the lever 50 to move to its position in FIG. 3, causing the main fluid and main vapor valves 44, 46 to close. Thus, sufficiently low pressure in the sensing path 68 causes the shut-off mechanism 62 to close the main valves 44, 46.

It should be understood that the shut-off device 62 can take any of a wide variety of forms such as those shown in, for example, U.S. Patent Application Publication No. US 2007/0267089 to Gray et al. (the entire contents of which are hereby incorporated by reference), U.S. Pat. No. 2,582,195 to Duerr (the entire contents of which are hereby incorporated by reference), U.S. Pat. No. 4,453,578 to Wilder (the entire contents of which are hereby incorporated by reference), U.S. Pat. No. 5,421,382 to Leininger et al. (the entire contents of which are hereby incorporated by reference), or U.S. Pat. No. 5,121,777 to Leininger et al. (the entire contents of which are hereby incorporated by reference).

Refueling systems that utilize a vapor boot 31 and a shut-off device 62, as described above, can experience nuisance or premature automatic shutoffs due to the vacuum generated by a liquid seal ORVR system. In particular, the vacuum created by an ORVR vehicle during refueling can sufficiently lower the pressure in the sensing path 68, thereby triggering the shutoff device 62 of the nozzle 18 before the fuel tank 40 is full. This requires the customer/operator to re-engage the nozzle 18, thereby adding wear and tear on the refueling components, and causing aggravation to the customer/operator. Alternately, or in addition, the vacuum created by an ORVR vehicle during refueling can cause vapor to be pulled from the underground storage tank 22, which can cause pressure imbalances in the system, and cause nuisance shut-offs at other nozzles 18/dispensers 12.

Figure 5:
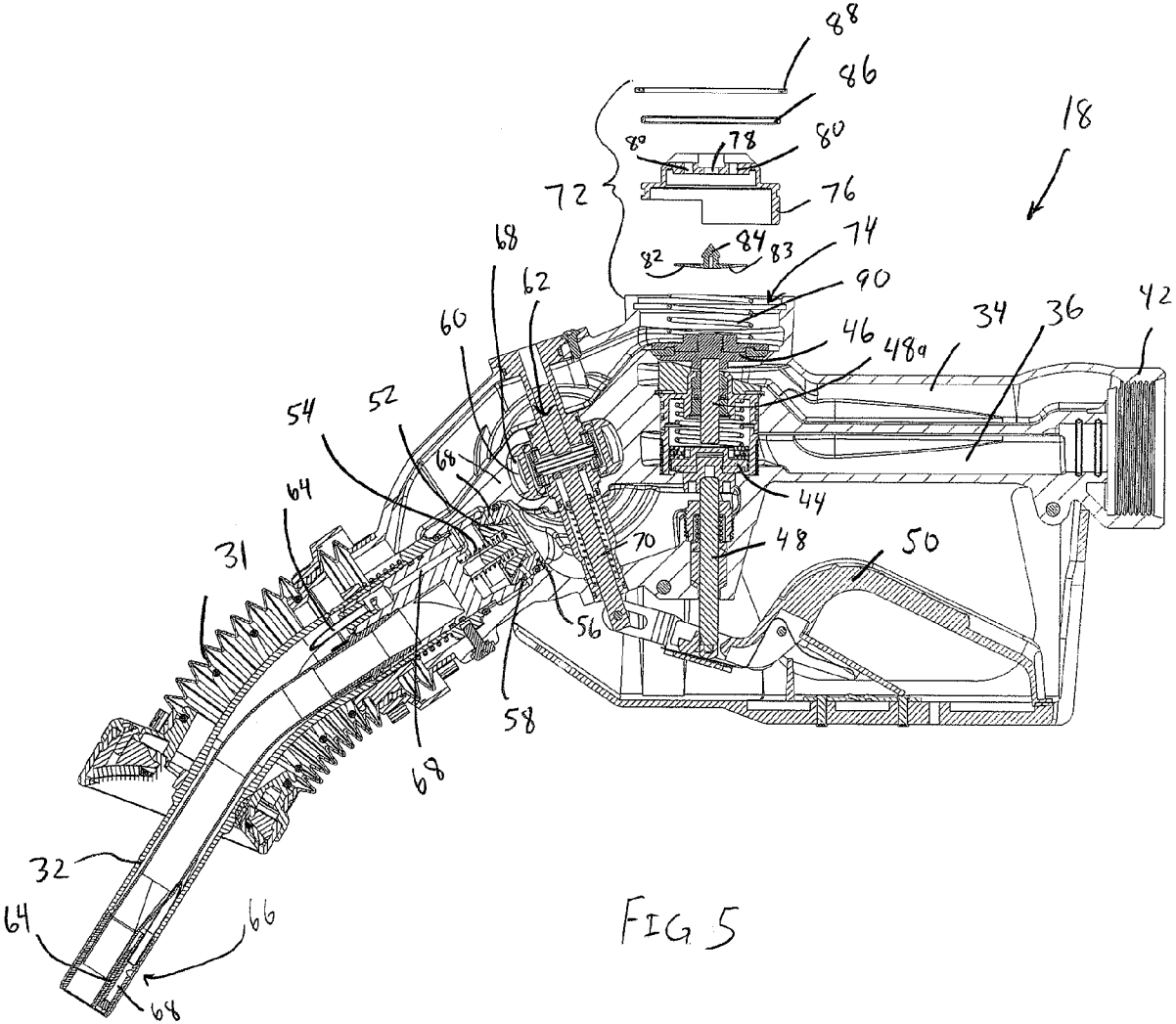
FIG. 5 is a side cross section of the nozzle of FIG. 3, with the relief valve exploded.
Figure 6:
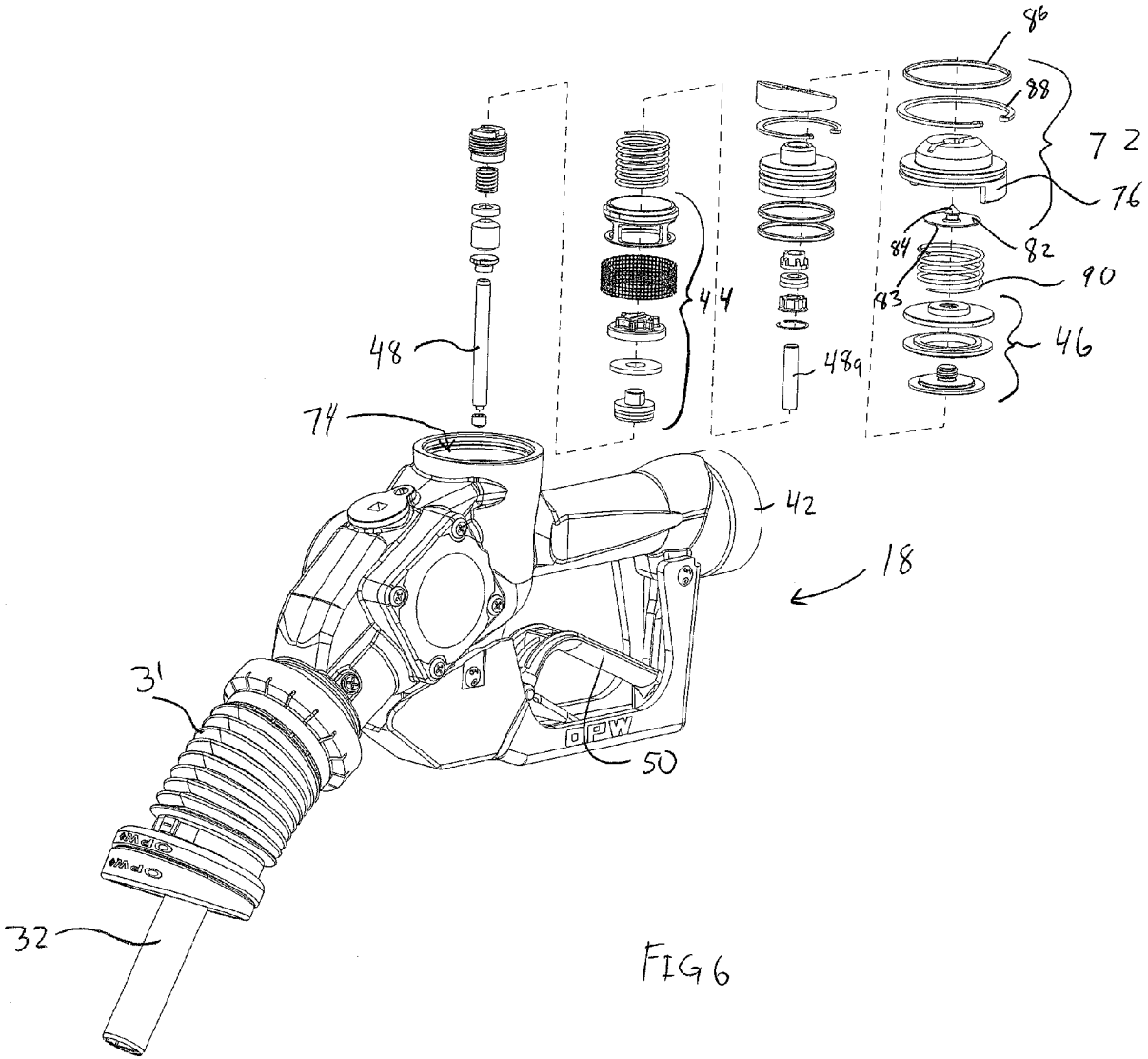
FIG. 6 is a front perspective view of the nozzle of FIG. 2, with the relief valve and main valves exploded.

Standard or non-ORVR vehicles (i.e. vehicles lacking an ORVR system) can also experience a temporary vacuum in the vehicle tank fill pipe in a condition known as "vapor collapse." In particular, the ullage space in the vehicle fuel tank can sometimes reside at an elevated temperature and/or pressure. When fuel from the underground storage tank is dispensed into the tank of a hot vehicle, the vapor in the hot vehicle tank is rapidly chilled by the cooler fuel, thereby correspondingly reducing the pressure in the ullage space of the vehicle fuel tank. As the vapor in the vehicle tank shrinks, a negative pressure or vacuum is created in the vehicle tank ullage space and fill pipe 38, resulting in vapor collapse, which can also cause nuisance shut-offs or other problems as described above Accordingly, the nozzle 18 may include a relief valve 72 mounted or incorporated therein to accommodate reduced pressure in the system/fill pipe 38. As best shown in FIGS. 2-5, the relief valve 72 is positioned adjacent to, or fluidly communicates with, the vapor path 34, on the one hand and the outside/ambient environment on the other. Although the relief valve 72 directly communicates with the vapor path 34, the relief valve 72 indirectly communicates with the sensing path 68 since a reduced pressure applied by the tank 40 to the sensing path 68 would also be applied to the vapor path 34. As best shown in FIGS. 5 and 6, the nozzle 18 may include an upper opening 74, which is generally cylindrical in the illustrated embodiment, in which the relief valve 72 is received. A valve housing 76 is closely received in the upper opening 74. The valve housing 76 is generally sealed/continuous in the axial direction, except for a center or valve seat opening 78 and a pair of flow openings 80 located on either side of the center opening 78.

The relief valve 72 includes a flapper 82 with a generally flat, circular body portion or movable portion 83 and a central barbed tip 84 extending upwardly from the body portion 83. The barbed tip 84 is configured to fit through the center opening 78 of the valve housing 76 to securely couple the flapper 82 to the valve housing 76. The body portion 83 of the flapper 82 is generally flexible and resilient, and configured to generally cover and extend radially past the flow openings 80 of the valve housing 76. The relief valve 72/flapper 82 can be made of any of a variety of materials. However, in one embodiment the relief valve 72/flapper 82 is made of flurosilicone, which remains stable in the presence of fuels and petroleum product, and remains stable and flexible at low temperatures.

An O-ring 86 is positioned between the valve housing 76 and the wall of the upper opening 74 of the nozzle 18 to seal the relief valve 72. Finally, a retaining ring 88 is positioned on top of the valve housing 76, and received in the nozzle 18, to secure the valve housing 76/relief valve 72 in place.

The relief valve 72 is movable between its closed position, wherein the relief valve 72 generally seals the openings 80 and blocks ambient air from entering into the vapor path 34 (FIG. 3), and an open position (FIG. 4), wherein the body portion 83 moves away from the valve housing 76 such that the relief valve 72 allows ambient air to enter into the vapor path 34. The relief valve 72 is biased into its closed position by the position and nature of materials of the flapper 82/body portion 83. However, when the pressure in the vapor path 34 is sufficiently low relative to ambient atmosphere, the body portion 83 is pulled away from the openings 80/valve housing 76, thereby allowing air to flow through openings 80/valve housing 76, as shown by an arrowed path 91 in FIG. 4.

Thus, in this manner, when a low pressure is present in the vapor path 34, such as due to refueling an ORVR vehicle, or due to a vapor collapse event, the relief valve 72 opens to allow surrounding, ambient air to enter into the vapor path 34 to alleviate the negative pressure in the tank 40/fill pipe 38, the vapor path 34 and the sensing path 68, and avoid nuisance shut-offs and undesired pressures in the system. In one embodiment, the relief valve 72 opens at a pressure differential of between about 1.5 inches and about 2.5 inches water column, and more particularly about 2 inches water column in one case, although the valve 72 can be adjusted as desired to accommodate the specific operating characteristics of any particular system.

Once sufficient air has entered into the vapor path 34 and the vacuum is sufficiently alleviated, the relief valve 72 returns to its closed position. In this manner, the nozzle 18 can operate smoothly and avoid nuisance shutoffs, without user intervention. The relief valve 72 also relieves the vacuum from ORVR vehicles before the vacuum has a chance to act on the underground storage tank 22, thereby helping to manage the pressure of the underground storage tank 22 and avoiding excessively strong vacuum pressures from being generated therein. Conversely, when a positive pressure is in the vapor path 34 (such as when refueling non ORVR vehicles), the relief valve 72 is closed, and in fact biased further closed by the positive pressure, thereby preventing vapors from escaping into the atmosphere.

The relief valve 72 is, in the illustrated embodiment, generally coaxially mounted with the main vapor valve 46 and main fluid valves 44 (and/or mounted directly above the main vapor valve 44 and main fluid valve 46, and immediately adjacent to the main vapor valve 46). Thus, as can be seen in FIGS. 3-5, when the relief valve 72 is assembled, the main vapor valve spring 90, which biases the main vapor valve 46 to its closed position, engages the underside of the valve housing 76, which acts as the valve seat for the relief valve 72.

This mounting arrangement is advantageous in that the valve housing 76/relief valve 72 serves the dual function of both providing relief venting functions, as described above, and providing access to the main vapor valve 46 and main fluid valve 44. In particular, if access is required to the main vapor valve 46 and/or main fluid valve 44, the relief valve 72 can be removed, and access is thereby provided to the main vapor valve 46 and main fluid valve 44 via the upper opening 74. This arrangement also provides ease of manufacturing, as the main fluid valve 44, main vapor valve 46, and relief valve 72 can each be assembled in/through the upper opening 74. This configuration also reduces the number of openings in the nozzle body 18, thereby increasing the strength and integrity of the nozzle body 18, and reducing potential leak points.

Figure 2:
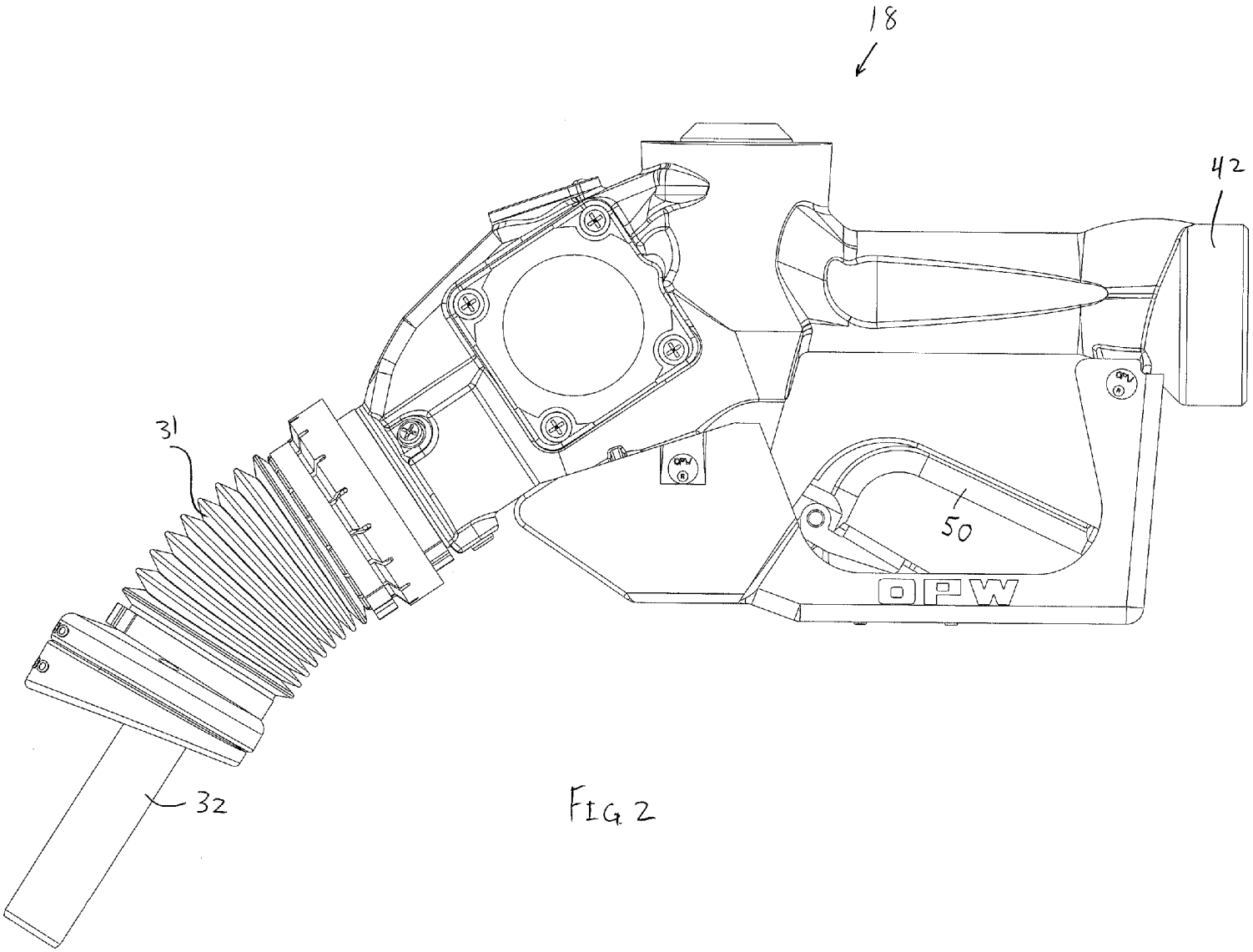
FIG. 2 is a side view of a nozzle of the system of FIG. 1.

In addition, in the illustrated embodiment the relief valve 72 is positioned at or adjacent to the highest position of the vapor path 34 in the nozzle 18 when the nozzle 18 is in its refilling position (i.e., in one case, when the spout 32 is angled downwardly and/or the axis of the outlet 42, or the adjacent fluid path 36 or vapor path 34, extend generally horizontally, as shown in FIGS. 2-4). This positioning of the relief valve 72 helps to minimize any chances that fluid, such as fuel, that enters into the vapor path 34 would escape through the relief valve 72.

In particular, when a user tops off their tank 40, fuel could be forced into the vapor path 34. If the relief valve 72 were to be located in a relatively low-lying position, fluid in the vapor path 34 could more easily reach the relief valve 72. In order to ensure a light-weight design, the relief valve 72 may not be fluid tight, and therefore fluid in the vapor path 34 might be able to escape through the relief valve 72, thereby contaminating the surrounding environment. However, by placing the relief valve 72 at a relatively high position in the vapor path 34, the chances of such contamination are minimized. If the relief valve 72 is not positioned at the highest position of the vapor path 34 in the nozzle 18, it may be positioned within at least about 1 inch, or at least about 0.5 inches, in either horizontal distance or vertical height, of such highest position.

The particular position of the relief valve 72 above the main vapor valve 46 and main fluid valve 44 is also advantageous since the relief valve 72 is positioned away from the lever 50/operator's hand, so that the operator's hand, when grasping the nozzle 18, does not block or interfere with operation of the relief valve 72. The positioning of the relief valve 72 also ensures that the relief valve 72 does not bump against the vehicle during refueling, or against the dispenser body 14 when the nozzle 18 is holstered.

In some systems, manufacturers may place holes, vents, apertures or openings (collectively termed "openings" herein) in the bellows to allow ambient air to be drawn in into the bellows, thereby alleviating pressure when the nozzle is used with an ORVR vehicle. However, while such openings may alleviate pressure when used in conjunction with ORVR vehicles, when the associated nozzle is used with a non-ORVR vehicle, the openings allow vapor to escape therethrough, particularly since the inside of bellows of balanced systems are typically at a positive pressure when non ORVR vehicles are refilled. Thus, the bellows 31 used with the nozzle 18 described herein may be generally continuous, and lack any openings, or any significant openings formed therein (i.e. in one case, openings having a total surface area of greater than about 0.15 $mm^2$) to form a closed volume, which helps to ensure greater vapor capture.

In some cases, a cover may extend around the nozzle 18 to provide a finished appearance and protect the nozzle 18 from ambient conditions. If a cover is used, and the cover extends over the relief valve 72, the cover may include one or more openings positioned over the relief valve 72 to ensure the relief valve 72 can introduce air into the vapor path 34 to enable proper operation of the relief valve 72.

Although the relief valve 72 is illustrated in the form of a flapper, diaphragm or umbrella valve (collectively termed a diaphragm valve herein), it should be understood that the relief valve 72 can take the form of any wide variety of valves which allow flow therethrough at the desired pressure, including but not limited to check valves and the like. As described above, in the illustrated embodiment, the relief valve 72 is positioned upstream from the main vapor valve 46 with respect to the direction of the flow of recovered vapor through the vapor path 34. This arrangement ensures that the relief valve 72 is isolated from the underground storage tank 22 when the main vapor valve 46 is in the closed position, which helps to ensure the relief valve 72 is not opened due to negative pressures in the underground storage tank 22.

Although the invention is shown and described with respect to certain embodiments, it should be clear that modifications and variations will be apparent to those skilled in the art upon reading the specification, and the present invention includes all such modifications and variations.

What is claimed is:

1. A nozzle system comprising:

a nozzle body configured to dispense fuel through a fuel path thereof into a vehicle tank, said nozzle body including a vapor path configured such that vapor recovered from said vehicle tank during refueling is passable therethrough, the nozzle body having an opening therein;

a manually operable main vapor valve positioned in said vapor path and configured to selectively block said vapor path, wherein said main vapor valve is movable to a position wherein said main vapor valve does not block said vapor path;

a manually operable main fluid valve; and a relief valve in fluid communication with said vapor path, said relief valve including a moveable portion biased away from said main vapor valve to bias said relief valve in a closed position, said moveable portion being configured to move toward said main vapor valve to open said relief valve and to allow ambient air to enter into said vapor path when low pressure sufficient to at least partially open said relief valve is present in said vapor path;

wherein said main vapor valve, said main fluid valve, and said relief valve are all in axial alignment and are all positioned within said opening of said nozzle body.

2. The nozzle system of claim 1 wherein said relief valve is movable between a closed position wherein said relief valve generally blocks ambient air from entering into said vapor path and an open position wherein said relief valve allows ambient air to enter into said vapor path, wherein said relief valve is automatically movable into said open position when said low pressure is present in said vapor path.

3. The nozzle system of claim 1 wherein said relief valve includes the movable portion and a valve seat, and wherein said movable portion is urged into contact with said valve seat when a positive pressure, relative to the ambient pressure, is present in said vapor path.

4. The nozzle system of claim 1 wherein said relief valve is positioned at or adjacent to a highest position of said vapor path in said nozzle body when said nozzle body is in a dispensing position.

5. The nozzle system of claim 1 wherein said relief valve is positioned upstream of said main vapor valve in said vapor path with respect to the direction of recovered vapor flow when said main vapor valve is open and when said main vapor valve is closed.

6. The nozzle system of claim 1 wherein said main vapor valve is movable between an open and a closed position in an axial direction, and wherein said relief valve is aligned with said axis of main vapor valve.

7. The nozzle system of claim 1 wherein said relief valve is positioned immediately above said main vapor valve when said nozzle is in a dispensing position.

8. The nozzle system of claim 1 wherein said relief valve is configured to open when the vapor path is at a negative pressure of about 1.5 inches of water column gage or less relative to ambient pressure.

9. The nozzle system of claim 1 wherein said relief valve and said main vapor valve are configured such that when said relief valve is removed from said opening said opening provides access to said main vapor valve.

10. The nozzle system of claim 1 further including a shut-off device configured to cause said nozzle to move to a state wherein said fluid path and said vapor path are generally blocked when a low pressure sufficient to actuate said shut-off device is applied to said shut-off device.

11. The nozzle system of claim 1 wherein said relief valve is a diaphragm valve, and wherein said main vapor valve is manually movable to said position wherein said main vapor valve does not block said vapor path.

12. The nozzle system of claim 1 wherein said nozzle includes a spout and a boot generally receiving a base end of said spout therein, said boot being configured to generally form a seal with a vehicle body around said spout when said spout is inserted into a fuel tank or fill pipe of a vehicle, and wherein said boot lacks any openings formed therethrough.

13. A nozzle comprising:

a nozzle body configured to dispense fuel through a fuel path thereof into a vehicle tank, said nozzle body including a vapor path configured such that vapor recovered from said vehicle tank during refueling is passable therethrough;

a main vapor valve positioned in said vapor path and configured to selectively block said vapor path;

a main fuel valve positioned in said fuel path and configured to selectively block said fuel path, wherein said main fuel valve is manually movable to a position wherein said main fuel valve does not block said fuel path, and wherein said relief valve is axially aligned with said main fuel valve; and a relief valve in fluid communication with said vapor path, said relief valve being configured to allow ambient air to enter into said vapor path when a sufficient pressure differential exists between said vapor path and ambient pressure, wherein said relief valve includes a moveable portion and a housing with at least one opening therein, said movable portion being positioned between said housing and said main vapor valve, wherein said relief valve is biased into a closed position wherein said movable portion seals said at least one opening of said housing, and wherein said moveable portion is moveable away from said housing and toward said main vapor valve to unseal said at least one opening when said sufficient pressure differential exists.

14. The nozzle of claim 13 wherein said relief valve is positioned immediately above said main vapor valve.

15. A nozzle system comprising:

a nozzle body configured to dispense fuel through a fuel path thereof into a vehicle tank, said nozzle body including a vapor path configured such that vapor recovered from said vehicle tank during refueling is passable therethrough, wherein flow through said vapor path is operatively controlled by a main vapor valve in said nozzle body;

a shut-off device in fluid communication with said vapor path, wherein said shut-off device is triggered at a first pressure differential within said vapor path;

a relief valve in fluid communication with said vapor path and in axial alignment with said main vapor valve, said relief valve being configured to open to allow ambient air into said vapor path when sufficiently low pressure is present in said vapor path to reduce nuisance shut-offs during fuel dispensing, wherein said relief valve is opened at a second pressure differential within said vapor path, and wherein said vapor path remains open when said relief valve is open;

wherein the first pressure differential is greater than the second pressure differential.

16. A method for dispensing fuel comprising:

providing a refueling system with a nozzle having a fuel path, a vapor path, a main vapor valve positioned in said vapor path and configured to selectively block said vapor path, a relief valve in fluid communication with said vapor path, wherein said relief valve is generally aligned with said main vapor valve, and a shut-off device in fluid communication with said vapor path;

allowing fuel to flow through said fuel path into a vehicle tank;

allowing vapors from said vehicle tank to enter said vapor path during said first allowing fuel to flow step; and allowing said relief valve to open when there is a pressure differential sufficient to open said relief valve between said vapor path and the ambient atmosphere to thereby at least partially dissipate said pressure differential to reduce nuisance shut-offs whereby said shut-off device is triggered by a pressure differential greater than said pressure differential sufficient to open said relief valve, wherein said vapor path remains open when said relief valve is open.

17. The method of claim 16 wherein said relief valve resides in a closed position when said pressure differential is not sufficient to open said relief valve, and wherein said relief valve moves to an open position when the pressure in said vapor path is sufficient to open said relief valve.

18. The method of claim 16 further comprising the step of allowing a vacuum to be applied to said refueling system by an on-board vapor recovery system of a vehicle associated with said vehicle tank, wherein said applied vacuum at least partially contributes to said pressure differential.

19. The method of claim 16 wherein said allowing said relief valve to open step includes allowing ambient air to enter into said vapor path via said relief valve.

20. The method of claim 16 wherein the method further includes, before said allowing fuel to flow step, allowing a user to manually move the main vapor valve to an open position wherein said main vapor valve does not block said vapor path, and wherein said relief valve is positioned upstream of said main vapor valve in said vapor path with respect to the direction of recovered vapor flowing therethrough.

21. The method of claim 16 wherein the method further includes allowing said shut-off device to move to a state wherein said fluid path and said vapor path are generally caused to be blocked when a low pressure sufficient to actuate said shut-off device is applied to said shut-off device.

22. The system of claim 1 wherein said relief valve is exposed to an entire pressure of fluid in said vapor path when said main vapor valve is open.

23. The system of claim 13 wherein said main fuel valve is positioned between said relief valve and said main vapor valve, or said main vapor valve is positioned between said relief valve and said main fuel valve.

24. The system of claim 1 wherein said main vapor valve is biased into a closed position by a vapor valve spring, and wherein said moveable portion of said relief valve is positioned entirely radially inside said vapor valve spring.

25. A method of assembling a nozzle comprising:

providing a nozzle body having a fuel path, a vapor path, and an opening therein;

inserting a main fluid valve through said opening and positioning said main fluid valve in said fluid path to operatively control flow through said fuel path;

inserting a main vapor valve through said opening and positioning said main vapor valve in said vapor path to operatively control flow through said vapor path, wherein said main vapor valve is axially aligned with said main fluid valve; and after said first two inserting steps, inserting a relief valve through said opening and in communication with said vapor path, wherein said relief valve is axially aligned with said main fluid valve and said main vapor valve, and wherein said relief valve is operatively connected to said vapor path to allow ambient air to enter into said vapor path when low pressure sufficient to at least partially open said relief valve is present in said vapor path.

* * * * *